United States Patent [19]

Kajita et al.

[11] Patent Number: 4,463,549

[45] Date of Patent: Aug. 7, 1984

[54] APPARATUS FOR MAKING FASCIATED SPUN YARN

[75] Inventors: Koji Kajita, Omihachiman; Takashi Nakayama; Seiichi Yamagata, both of Otsu, all of Japan

[73] Assignee: Toray Industries, Inc., Tokyo, Japan

[21] Appl. No.: 390,682

[22] Filed: Jun. 21, 1982

[30] Foreign Application Priority Data

Jun. 30, 1981 [JP] Japan ..... 56-100557
Jul. 7, 1981 [JP] Japan ..... 56-105025

[51] Int. Cl.[3] ..... D01H 5/28; D01H 1/12
[52] U.S. Cl. ..... 57/328
[58] Field of Search ..... 57/328, 5, 908, 6, 12, 57/315

[56] References Cited

U.S. PATENT DOCUMENTS

| | | | |
|---|---|---|---|
| 3,009,309 | 11/1961 | Breen et al. | 57/139 |
| 3,079,746 | 3/1963 | Field, Jr. | 57/51 |
| 3,367,095 | 2/1968 | Field | 57/328 X |
| 3,732,684 | 5/1973 | Csok et al. | 57/140 |
| 3,978,648 | 9/1976 | Yamagata et al. | 57/144 |
| 3,992,865 | 11/1976 | Tuchida et al. | 57/51 |
| 4,003,194 | 1/1977 | Yamagata et al. | 57/51 |
| 4,112,658 | 9/1978 | Morihashi | 57/328 |
| 4,114,358 | 9/1978 | Tsuchida et al. | 57/328 |
| 4,142,354 | 3/1979 | Nakahara | 57/328 |
| 4,183,202 | 1/1980 | Morihashi | 57/328 |
| 4,327,545 | 5/1982 | Fehrer | 57/5 |

*Primary Examiner*—Donald Watkins
*Attorney, Agent, or Firm*—Austin R. Miller

[57] ABSTRACT

Herein disclosed is a spinning frame of vortex flow type, which is composed mainly of a roller draft unit, a pneumatic false twisting unit and a take-up unit. A pneumatic tube having a rectangular cross-section is interposed between the roller draft unit and the pneumatic false twisting unit so that many floating fibers to be fasciated may be generated to make a fasciated spun yarn which has high strength and excellent quality.

6 Claims, 12 Drawing Figures

APPARATUS FOR MAKING FASCIATED SPUN YARN

BACKGROUND OF THE INVENTION

1. Field of the Invention

The present invention relates to improvements in a pneumatic duct which is interposed between the roller draft unit and the pneumatic false twisting unit of a vortex flow type spinning frame, and provides an improved pneumatic duct which permits an increase in the amount of staple fibers which wrap core fibers to make a fasciated spun yarn. The spun yarn produced using the apparatus of the present invention has enhanced strength.

The present invention further provides an apparatus for making a spun yarn having such uniform quality that it is free from any fuzz neps and deteriorated fibers, even where the spinning operation is performed at high speed, and which has uniform, enhanced strength throughout.

Furthermore, the present invention relates to improvements in the pneumatic duct of a vortex flow type spinning frame and provides a pneumatic duct in which free fibers are resistant to being pulled into an opening connected with a vacuum source when fibers having excellent openability are being spun.

In recent years, as a novel spinning method in place of an open-end spinning method, there has been introduced a fasciated yarn spinning method which has excellent characteristics such aspects as energy saving speed-up and guide spinnable range. According to this technique, a fasciated spun yarn, which is composed of a bundle of substantially untwisted core fibers and wrapping fibers which wrap and fasciate the core fibers, is made by false-twisting a bundle of ribbon-shaped fibers which have been drafted by rollers, that is, a flattened bundle of fibers, by generating floating fibers having free ends which are free from being twisted into the bundle of twisted fibers, by either integrating the floating fibers in their untwisted state with the aforementioned bundle of twisted fibers or wrapping the floating fibers around the twisted fiber bundles with a difference in the number of twists, and by subsequently detwisting them.

In the technique thus disclosed, most of the fibers are made into the bundle of twisted fibers by twisting the ribbon-shaped fiber bundle which has been drafted while leaving at least one leading end of the fibers of the ribbon-shaped bundles free. The floating fibers are considered to be generated by delivering those fibers having free ends separately from the twisted fiber bundle. From the standpoint of the construction of the spinning apparatus, therefore, an important consideration is the delivery means for delivering the fibers having the free end separately from the twisted fiber bundle.

This fiber delivering means has been proposed according to the prior art in several forms, all of which have been unsatisfactory.

2. Description of the Prior Art

As the fiber delivering means according to the prior art, there is widely known a method (e.g. U.S. Pat. No. 3,079,746) which utilizes an aspirator. However, this delivery means is unsuitable for stable delivery of fibers because the air flow in the yarn passage becomes turbulent and has great fluctuation.

As another means, there has been proposed a pneumatic tube which uses a suction air flow to allow a yarn to pass therethrough in a linear form, as is disclosed in U.S. Pat. No. 4,003,194. This delivery means provides excellent stability in delivery because the air flow is only slightly disturbed. However, the use of a cylindrical tube in this method does not produce sufficient generation of floating fibers and makes it difficult to spin a strong yarn.

According to the method disclosed in U.S. Pat. No. 4,112,658, two false twisting nozzles are used in series, inserting false twist in opposite directions to form surface wrapping fibers. However, this method is not satisfactory due to the higher cost of the compressed air as a result of using two nozzles, and the hard feeling of the yarn produced because the surface wrapping fibers are firmly trapped.

Of the prior art examples thus far described, the method most closely resembling the present invention, which is disclosed in U.S. Pat. No. 4,003,194, will be described in detail as follows.

In this particular method bundles of staple fibers are drafted and delivered in an open state, while being fed to aprons which allow the false twist imparted at a position downstream thereof to be propagated to an upstream nip point, such that the fibers positioned mainly in the middle of the fiber stream are false-twisted on the aprons to generate peripheral fibers around the false-twisted fiber bundle. The peripheral fibers have at least one end free from the false-twisting actions or are in a similar state, such that these peripheral short fibers are subsequently wrapped around the false-twisted fiber bundle, after it has left the false-twisting unit, in a direction opposite to the false-twisting direction.

The spun yarn made by the method thus far described is in such a form that the main fibers occupying a major portion of the yarn are held in substantially untwisted states and bundled by the free fibers. Therefore, the strength, feeling, the extent of bundling irregularity of the spun yarn and so on are highly depending upon the amount and state of wrapping of the free fibers.

In order to increase the extent of wrapping of the free fibers around the core fiber bundle, a pneumatic duct is interposed between the roller draft unit and the pneumatic false twisting unit. The present invention relates to improvements of the yarn making apparatus using the pneumatic duct.

FIG. 1 is a schematic view showing a vortex flow type spinning frame. A material to be drafted, i.e., a bundle of short fibers 1 is drafted by the action of a pair of back rollers 2, a middle roller 3, and a pair of front rollers 4. Around these front rollers 4, there are disposed a pair of aprons 5 and 5' which are made to run together with the front rollers 4 and which have their delivery side ends forming a gap S in between. The short fiber bundle 1 thus drafted is false twisted by the action of a false twisting nozzle 9. In this case, the false twisting action is mainly concentrated upon the center portion of the short fiber and the twist transference reaches through the gap S between the aprons 5 and 5' to the nip point of the aprons.

The peripheral fibers on both the sides of the aprons, which are left free from the false twisting action and have at least either end free, are wrapped with a relatively low twist either while they are being delivered by the aprons or after they have been delivered from the aprons upon the core fiber bundle which has been twisted. The strongly twisted core fiber bundle is detwisted simultaneously as it passes through the false twisting nozzle 9, and the free peripheral fibers are wrapped around the core fiber bundle.

In front of the false twisting nozzle 9, there is disposed a pneumatic duct D through which air is caused to flow by means of a suction tube 8 connected with a vacuum system through an opening 7 formed in an end portion of a pneumatic tube 6. The spun yarn 1*a* thus made is passed through a pair of delivery rollers 10 and wound to form a package 11.

FIG. 2 is a top plane view showing a yarn forming unit which is disposed in the pneumatic duct according to the prior art. This pneumatic duct D is constructed, as shown in FIG. 3, of pneumatic tube 6 and suction tube 8 which has communication with an exhausting device connected with the end portion of the pneumatic tube 6, and this pneumatic tube 6 is formed with opening 7 at the end portion thereof.

The aforementioned pneumatic duct D according to the prior art has its front portion 6*a* formed by a rectangular cross-section opening. The duct is gradually constricted and its rear portion 6*b* is formed by a generally circular neck until it is connected with suction tube 8. The rear portion 6*b* is formed with an opening 6*c* for guiding the yarn.

Since the pneumatic duct D, having the construction thus far described, is so constructed that the air flow produced passes as close to the middle as possible, the suction air flows over the apron 5', as indicated by arrows $A_1$. In the pneumatic duct D of the prior art, consequently, the air flow toward said middle center portion of the apron 5, through which the false twisted yarn 1*b* is passing, is intensified, which means that an air-flow directed to the twisted fiber bundle at substantially a right angle to said bundle, so that the floating fibers, i.e., the free fibers F are promptly wrapped around the core fiber bundle and there should be no chance of producing free fibers along said twisted core bundle of fibers. Recently, an improvement in the hard feeling of the fasciated spun yarn has been desired for various applications. For this purpose, a spun yarn having its fasciated state loosened to produce a softer feeling yarn is desired. In the field of carpet, on the other hand, an improvement in the openability of the surface fibers in cut pile carpet, such as velour carpet, is desired.

The free peripheral fibers play an important role in ensuring that the strength of the spun yarn be sufficient, as has been described hereinbefore. However, problems occur when a yarn is to be spun with a low twist so as to improve the feeling of the spun yarn. More specifically, if the twist is low or loose, the twisting transference is not sufficient, and the amount of the free fibers is accordingly reduced so that a sufficiently strong spun yarn cannot be made.

An object of the present invention is to eliminate the aformentioned disadvantages concomitant with the prior art and to provide a pneumatic duct which directs the flow of air along the direction of a running yarn.

SUMMARY OF THE INVENTION

The spinning apparatus of the present invention has a pneumatic tube characterized in that its cross-section normal to the running direction of a yarn is rectangular.

It is preferable that the pneumatic tube of the present invention form a rectangular parallelepiped, as viewed along the running direction of the yarn.

DESCRIPTION OF THE PREFERRED EMBODIMENTS

The present invention will now be described in connection with the embodiments thereof with reference to the accompanying drawings.

It is to be noted that the pneumatic duct of the present invention can also be used in a spinning frame of the type not having aprons 5 and 5', such as a spinning frame using an aspirator in place of the aprons and likewise in a spinning frame using a pneumatic false twisting nozzle in place of the aprons or a spinning frame using no fiber delivering means such as the aprons, the aspirator or the pneumatic false twisting nozzle. However, the following description is directed to the spinning frame of the type using aprons 5 and 5'.

Figure 4:
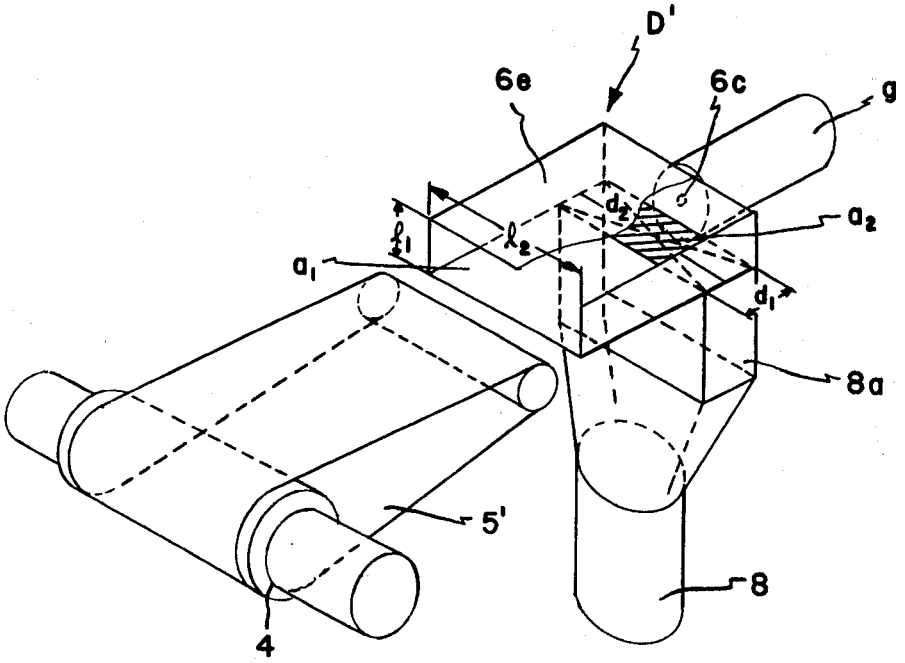
FIG. 4 is a partially cutaway perspective view showing a twisting unit using a pneumatic duct of the present invention.
Figure 5:
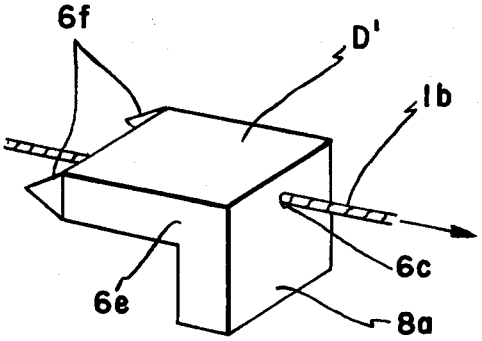
FIG. 5 is a perspective view showing the back of the pneumatic duct of the present invention.

FIGS. 4 and 5 are perspective views showing a pneumatic duct D' of the present invention. A pneumatic tube 6*e* is formed with a rectangular cross-section and with an opening $a_1$ which has a width $l_2$ and a height $l_1$. Moreover, the aforementioned pneumatic tube 6*e* is formed at its downstream end with an opening $a_2$ which has communication with the suction tube 8 and which is formed in a rectangular shape having a width $d_2$ and a height $d_1$.

A suction portion 8*a*, having the aforementioned opening $a_2$, has a rectangular cross-section, which is gradually deformed into a circular shape which connects with a suction tube 8 which in turn is connected with a vacuum system.

The openings $a_1$ and $a_2$ exert remarkable influences upon the amount of free or floating fibers which are generated either over the apron 5' or in the gap S between the aprons 5 and 5'. In the present invention, in order to establish the air flow patterns which produce the prominent effects desired, it is essential that the flow of air which is perpendicular to the twisted yarn formed in the center portion of the aprons as much as possible and to increase the flow parallel to said yarn as much as possible. For this purpose, according to the present invention, the opening $a_2$ is similar to the opening $a_1$ of the pneumatic tube 6e, having a rectangular cross-section where it is connected with suction tube 8.

Pneumatic tube 6e has a cross-sectional shape identical to or slightly reduced from the cross-sectional shape of the opening $a_1$ throughout its entire length. Moreover, the opening $a_2$ formed in the upper or lower wall of the pneumatic tube 6e may also be shaped identical to or slightly reduced from the aforementioned inlet opening $a_1$.

It has been found that the best results can be obtained by making the cross-section of the pneumatic tube 6e a rectangular shape such that the width $l_2$ of the opening $a_1$ is at least three times as large as the height $l_1$, that the width $d_2$ of the opening $a_2$ is at least two and one-half times as large as the height $d_1$, and that the relationships of $l_2 \geqq d_2 > \frac{3}{4} l_2$ hold among the above identified dimensions.

Figure 6:
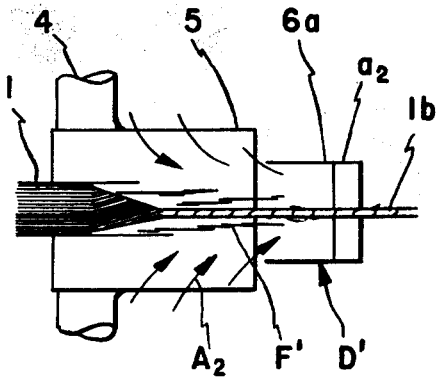
FIG. 6 is a top plane view of the twisting unit and schematically illustrates the action of air flow in the pneumatic duct of the present invention.

FIG. 6 is a view illustrating the action of the pneumatic duct D' according to the present invention. The air flows which flow along the twisted yarn 1b, effectively occur as indicated by arrows $A_2$, so that many free fibers F' are produced and they can be transferred along said twisted yarn 1b for a while without being trapped by said twisted yarn 1b. Afterwards, the free fibers F' are twisted as they are gradually wrapped around the surface of yarn 1b before they reach the false twister.

As shown in FIGS. 4 and 5, the pneumatic tube 6e yarn guide hole 6c at the downstream end, through which the yarn 1b, which is being false-twisted, is guided and treated is thus false-twisted by pneumatic false twisting nozzle 9.

Figure 2:
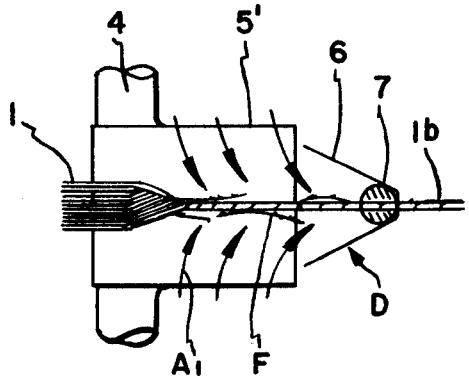
FIG. 2. Prior Art
FIG. 2 is a top plane view of a twisting unit and schematically illustrates the action of air flow in a pneumatic duct of the prior art.
Figure 3:
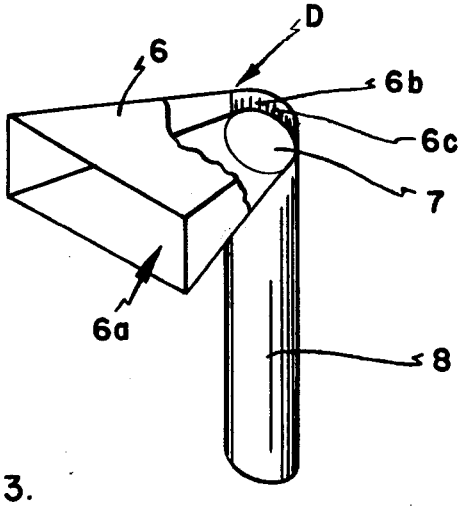
FIG. 3 is a partially cutaway perspective view showing the pneumatic duct of the prior art.

As the width $l_2$ of opening $a_1$ becomes closer to the height $l_1$, the air flow perpendicular to the yarn 1b, which is to be twisted at the apron unit, is increased. On the other hand, as the width $d_2$ of opening $a_2$ becomes closer to the height $d_1$ its cross-sectional area is gradually reduced and air flows more resembling those in the pneumatic duct shown in FIG. 2 are exhibited.

Figure 7:
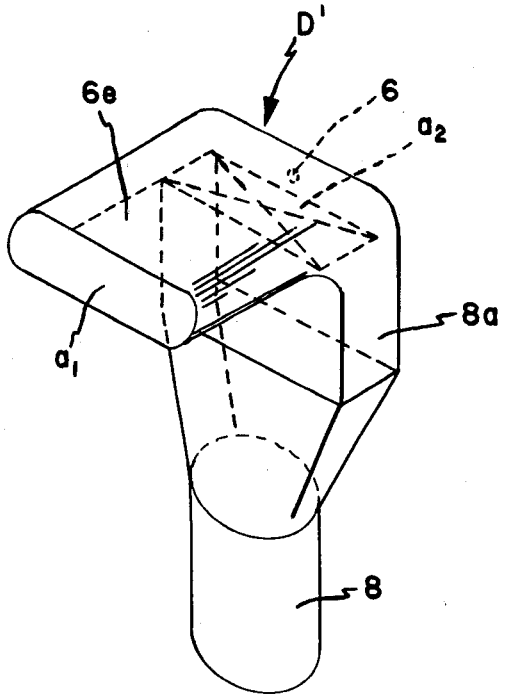
FIG. 7 is a perspective view showing a pneumatic duct according to another embodiment of the present invention.

FIG. 7 shows another embodiment in the present invention. Pneumatic tube 6e has rounded, arcuate shaped corners, the angle and the portion connecting with suction tube 8a is also formed into an arcuate shape so that the air flow required in the present invention may be smoothly generated. In this embodiment, too, the openings $a_1$ and $a_2$ are made to have a generally rectangular cross-section so that the air flows $A_2$ shown in FIG. 6 are positively generated above apron 5' by the action of the pneumatic duct D' making it possible to increase the amount of the free fibers F'. As shown in FIG. 5, pneumatic tube 6e may have side walls formed with triangular walls 6f which project toward aprons 5 and 5'. As a result, the direction of the air flow passing between the aprons 5 and 5' can be regulated to some extent to increase the amount of free fibers F'.

By constructing the pneumatic duct in the aforementioned manner according to the present invention, it is possible to increase the amount of the free fibers which wrap around the bundle of main fibers, i.e., the bundle of core fibers. According to the present invention, therefore, free fibers can be generated in a sufficient amount, even if the twisting action is weak, so that a spun yarn having high strength and an excellent feeling can be made.

Figure 8:
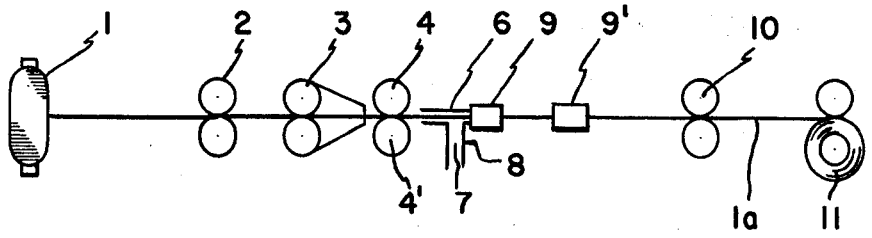
FIG. 8 is a schematic view showing a vortex flow type spinning frame using a pneumatic duct according to a further embodiment of the present invention.

FIG. 8 shows another embodiment of the present invention, in which two pneumatic false twisting nozzles are arranged in series. A roving or sliver 1 is drafted by the roller draft units 2, 3 and 4. Next, the greater part of the fibers are false-twisted by pneumatic false twisting nozzle 9, but a part of the fibers are twisted into the bundle of false twisted fibers after they have been delivered by pneumatic tube 6. The false twisted fiber bundle is then more densely twisted by the action of nozzle 9' which has a false twist direction opposite to that of nozzle 9. The fiber bundle thus prepared is then detwisted, while it is passing through false twisting nozzle 9', so that the aforementioned fibers which are twisted later are wrapped around the surface of the yarn. The yarn thus prepared is nipped by delivery rollers 10 and taken up by a winder to form package 11.

In front of pneumatic false twisting nozzle 9, there is disposed pneumatic duct 6 through which air is pulled by the action of suction tube 8 connected with a vacuum system through opening 7 formed at the trailing end of pneumatic tube 8.

Figure 9:
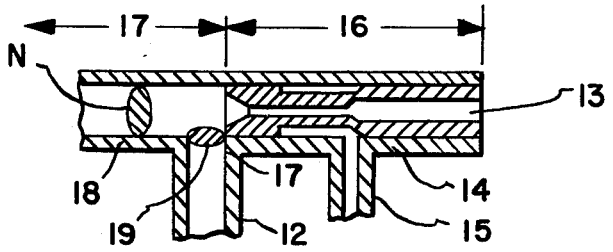
FIG. 9 is a sectional view showing the essential portions of the pneumatic duct and the pneumatic false twisting nozzle according to the prior art.

FIG. 9 shows the pneumatic duct and the false twisting nozzle of the prior art. More specifically, FIG. 9 is a sectional side elevation showing the apparatus in which a pneumatic duct 17 and a pneumatic false twisting nozzle 16 are combined. Pneumatic duct 17 is constructed of a cylindrical pneumatic tube 18 and a suction tube 12 which is connected with an opening 19 formed at the trailing end of pneumatic tube 18. False twisting nozzle 16 is provided at its center with a yarn guide hole 13 and an injection hole 14 which communicates with the former for swirling the air flow. Compressed air is supplied from a compressed air supply tube 15 and is injected from injection hole 14 thereby false twisting the yarn passing through yarn guide hole 13.

Pneumatic duct 17 of the prior art is constructed such that the minimum effective area N of pneumatic tube 18 is made sufficiently larger than the effective area n of vacuum opening 19 and such that the fiber bundle which has been delivered from front rollers 4 is smoothly pulled into suction tube 12 when the yarn is cut.

Where the fiber bundle is composed of 100% synthetic fibers, such as acrylic fibers or polyester fibers, few floating or free fibers are pulled into the suction tube during the spinning operation even if the pneumatic tube is opened to satisfy an inequality of $N > n$ between the effective area N of the pneumatic tube and the effective area n of the vacuum opening, and the amount of fibers pulled into the suction tube is geneerally 0.05 to 0.17% of the total amount of the delivered fibers so that no special problems arise.

However, problems do arise when a fiber bundle composed of fibers other than synthetic fibers is used. Specifically, if fibers having excellent openability, such as rayon or cotton or blends thereof are spun, there is a disadvantage in that the free fibers (or staple fibers) which do not wrap around the core fiber bundle, even in a normal spinning state, but are pulled into the pneumatic duct are increased.

Figure 10:
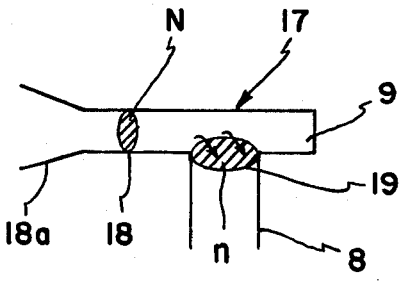
FIGS. 10 and 11 are schematic views showing pneumatic ducts according to further embodiments of the present invention.

In the present invention, therefore, the effective area n of vacuum opening 19 may be made larger than the minimum effective area of pneumatic tube 18, as shown in FIG. 10. In addition an inlet 18a may have an opening with a horn-like shape.

Figure 11:
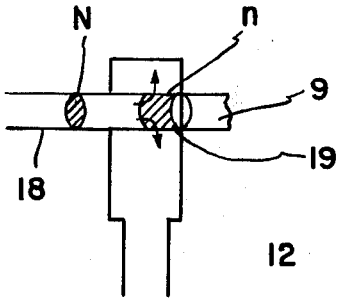

FIG. 11 shows another embodiment of the present invention. Pneumatic tube 18 has its trailing end portion opened over the entire circumference, and the opening communicating with suction tube 12 extends along the entire circumference of pneumatic tube 18. In this embodiment, too, the sectional area n of opening 19 is made far larger than the minimum effective area N of pneumatic tube 18. In this invention, it seems to be necessary to make the air-flow directed to the false twisting nozzle stronger than the air-flow directed to the pneumatic tube in order to provide inertial force on the free fibers in said tube.

According to many experiments which have been conducted, the boundary limit value of the ratio N/N of the effective areas 1, and the preferable effects of the pneumatic suction tube are obtained when $N/n \leqq 0.7$.

Upon determination of the ratio N/n, it is important in the twisting step to select the conditions under which the free short fibers are sufficiently accelerated in the pneumatic tube 18 and introduced into the yarn guide hole 13 of the pneumatic false twisting nozzle. It is also important to impart the inertial effects to the free fibers so that the fibers are not delivered through pneumatic tube 18 into opening 19.

From the facts thus far described, the ratio N/n is preferably set at a smaller value. If the suction of the free fibers is taken into consideration, however, it is necessary that the hole diameter in the N portion be at least 2 mm, that is, that a relationship of about $N \geqq \pi mm^2$ hold. The maximum value of the effective area n varies in accordance with the construction of the spinning frame, but is not especially limitative.

Moreover, if the state in which the free fibers are being delivered in the pneumatic tube is observed, the free fibers are delivered around the core fiber bundle which has been twisted. It is, therefore, necessary that the opening communicating with the vacuum system not obstruct the delivery of the free fibers.

For example, in the pneumatic duct of the prior art having an aperture ratio of $N/n = 2.78$, more than about 2% of the free fibers are pulled into the pneumatic duct when spinning a yarn which is composed of 65% polyester and 35% cotton and has a yarn number count of 45S. By constructing the spinning frame according to the present invention, the amount of fibers pulled into the suction tube can be reduced to less than 1%.

Figure 12:
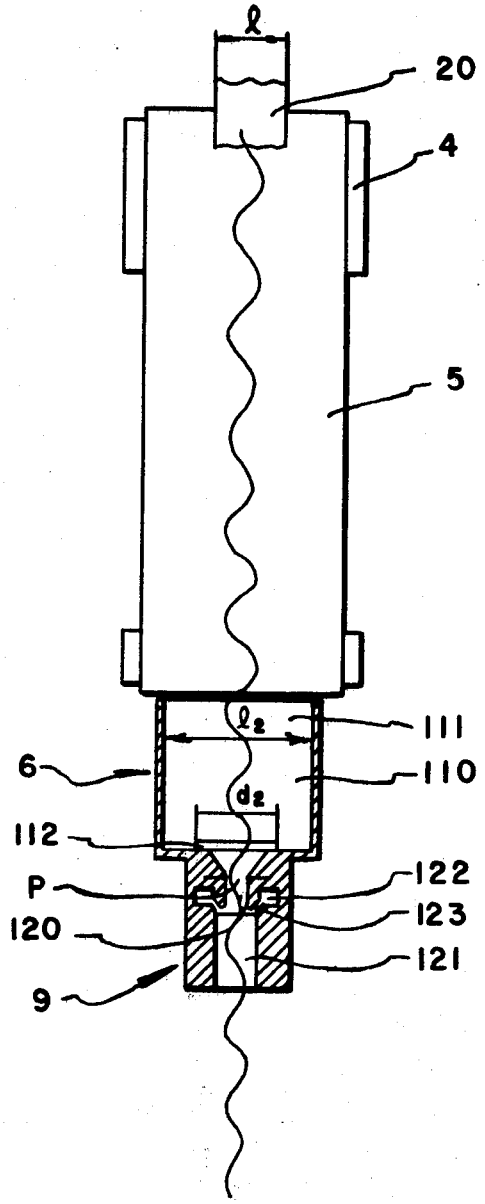
FIG. 12 is a schematic view showing an essential portion of the present invention.

The present invention can be modified as shown in FIG. 12.

With reference to FIG. 12, the spinning frame is constructed to satisfy the following relationships:

$$l_2,\ l \geqq 1.5;\ \text{and}\ d_2 10p,$$

wherein: l is the width of a bundle of fibers 20 before it is fed to pneumatic tube 6, i.e., the width of the fiber bundle before it is reduced by the twisting action of the pneumatic false twisting nozzle; $l_2$ is the width of inlet 111 of a fiber bundle guide passage 110 of pneumatic tube 6; $d_2$ is the width of the opening of a fluid suction port 112 (or the fluid outlet here an aspirator is used); and p is the diameter of an inlet 120 of the fluid twisting nozzle 9.

The collecting or trapping effect of the peripheral fibers around the fiber bundle in the pneumatic tube is influenced not only by the relationship between the width l of the fiber bundle and the width $l_2$ of the inlet of the fiber bundle guide passage of the pneumatic tube but also by the kind of ballooning action which is established by the rotations of the yarn. Since the intensity of this ballooning action of the yarn is related to the diameter p of the inlet of the fluid twisting nozzle, the width $d_2$ of the fluid suction port or outlet port of the pneumatic tube is determined from the relationship with the diameter p of the inlet of the fluid twisting nozzle.

Thus, the amount of inferior wrapping fibers are reduced, so that a spun yarn having uniform quality and high strength can be made.

In FIG. 12, reference numerals 121, 122 and 123 indicate a twisting portion, a compressed air chamber and an injection hole, respectively. The remaining reference numerals are the same as those which have already been described. Moreover, the aprons are not required, as has been described hereinbefore.

Since excellent fasciation is ensured, even with low twist according to the present invention, a spun yarn having a soft feeling can be continuously produced.

In addition, since the generation of free fibers is not reduced, a spun yarn having sufficient strength can be obtained even when the number of twists is drastically changed from large to small values. Moreover, since the amount of fibers pulled into the suction tube are reduced, the yield can be enhanced. Still moreover, the amount of inferior wrapping fibers can be reduced to produce a yarn having a uniform quality.

The present invention will now be described in conjunction with the following embodiments.

EXAMPLE 1

Figure 1:
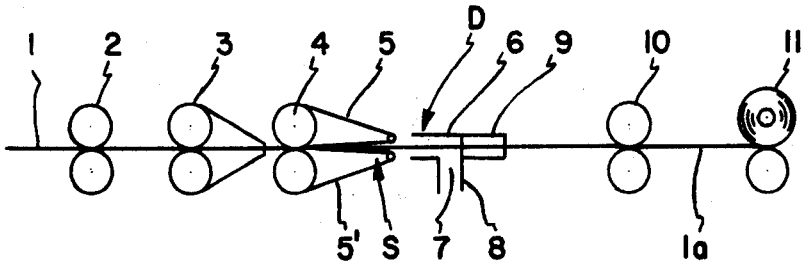
FIG. 1. Prior Art
FIG. 1 is a schematic view showing a vortex flow type spinning frame.

Slivers made of nylon staple having a single fiber denier of 7d were fed to the vortex flow type spinning frame shown in FIG. 1 to produce a spun yarn of 1/6 Nm. The pneumatic duct used for the spinning operation was constructed with triangular walls *6f* on both the sides of the inlet opening $a_1$ to reduce the gap between the conveyor bands (or the aprons), as shown in FIG. 5. The spinning conditions were as follows:

| | |
|---|---|
| Draft Ratio | = 38; |
| Velocity of Front Rollers (VF) | = 160.5 m/min.; |
| Velocity of Delivery Rollers (VD) | = 150 m/min.; |
| Percentage Over-Feed $\left(\frac{VF - VD}{VD} \times 100\right)$ | = 7%; |
| Injection Angle of Pneumatic False Twisting Nozzle | = 35 degrees; |
| Air Pressure | = 2.0 Kg/cm$^2$; |
| and Size of Pneumatic Duct | = $l_1$ = 16 mm, $l_2$ = 55 mm, $d_1$ = 15 mm and $d_2$ = 55 mm. |

The measured values of the strength of the spun yarn produced are tabulated in Table 1. Yarn produced according to the present invention exhibited increased strength. For example, the average strength of the yarn produced according to the present invention was 2.15 times that of yarn produced by prior art apparatus and the minimum strength of the yarn produced according to the present invention was 8 times greater than that of the yarn which was spun by the use of the pneumatic duct of the prior art.

TABLE 1

| | Prior Art | Present Invention |
|---|---|---|
| Average Strength (g) | 1147 | 2469 |
| Maximum Strength (g) | 2800 | 3600 |
| Minimum Strength (g) | 50 | 400 |

EXAMPLE 2

Slivers made of polyester staple having single fiber denier of 3d were fed to an apparatus similar to that of Example 1 to produce a spun yarn of 1/6 Nm. The spinning conditions were as follows:

| | | |
|---|---|---|
| Draft Ratio | = | 40 |
| Velocity of Front Rollers | = | 126 m/min. |
| Velocity of Delivery Rollers | = | 120 m/min. |
| Percentage Over-Feed | = | 5% |
| Air Pressure | = | 2.0 Kg/cm$^2$ |
| Injection Angle of Pneumatic False Twisting Nozzle | = | 70 degrees, and |
| Size of Pneumatic Duct | = | |
| $l_1$ = 16 mm $l_2$ | = | 55 mm |
| $d_1$ = 15 mm $d_2$ | = | 55 mm. |

The measured values of the strength of the spun yarn are tabulated in Table 2.

The strength of the yarn produced according to the present invention was greater. For example, the average strength of the yarn produced according to the present invention was 1.17 times that of yarn produced by prior art apparatus and the minimum strength of yarn produced according to the present invention was 2.3 times greater than that of the spun yarn which was made by the use of the pneumatic duct of the prior art.

TABLE 2

| | Prior Art | Present Invention |
|---|---|---|
| Average strength (g) | 2979 | 3490 |
| Maximum strength (g) | 4100 | 4800 |
| Minimum strength (g) | 800 | 1850 |

EXAMPLE 3

The spinning operation was conducted by the use of a vortex flow type fine spinning frame which had a three-line draft unit and a pair of upper and lower aprons having their leading ends opened and which was equipped with a rectangular pneumatic duct and a pneumatic false twisting nozzle downstream of these aprons, as shown in FIG. 1.

The roving used was a blend of 65% polyester of 1.3d×38 mm and 35% combed sliver of American cotton and was 0.55 g/m. The spinning conditions were: The total draft ratio=42; the yarn number count=45S; the velocity of the front rollers=100 m/min.; the working air pressure=1.75 Kg/cm$^2$; and the percentage of over-feed of the front rollers relative to the delivery rollers=5%.

The results are tabulated in Table 3. According to the present invention, the ratio of suction of the fiber was reduced to $\frac{1}{8}$, and the strength was improved.

TABLE 3

| | Diameter at N (mm) | Diameter at n (mm) | N/n | Fibers Pulled | Quality of Spun Yarn: Average Strength | Quality of Spun Yarn: U % |
|---|---|---|---|---|---|---|
| Prior Art | 10 | 6 | 2.78 | 2.7% | 198 | 12.95 |
| Present Invention | 4 | 7 | 0.38 | 0.85% | 210 | 12.5 |

EXAMPLE 4

The spinning operation was conducted under the same conditions as those of Example 3, and the ratio of fibers pulled was investigated for various N/n ratios. The results are tabulated in Table 4, from which it is found that the effect is appreciable for N/n≦1.0 and high for N/n≦0.7. A considerable effect cannot be obtained for a diameter at the N portion less than 4 mm. A diameter less than 2 mm is not preferable because bundling deterioration of the free fibers due to the reduction in the suction flow rate and clogging with fibers when the yarn is cut appear to take place.

TABLE 4

| Diameter at N (mm) | Diameter at n (mm) | N/n | Fibers Pulled % |
|---|---|---|---|
| 10 | 6 | 2.78 | 1.76 |
| 8 | 6 | 1.78 | 1.45 |
| 7 | 6 | 1.86 | 1.25 |
| 6 | 6 | 1.00 | 0.9 |
| 5 | 6 | 0.69 | 0.45 |
| 4 | 6 | 0.44 | 0.35 |
| 2.5 | 6 | 0.17 | 0.30 |

EXAMPLE 5

In the apparatus shown in FIGS. 1 and 12, a pneumatic tube set at $l_2/l=2.5$ and $d_2=30$ p was used to spun slivers which were made of polyester fibers having 1.5 deniers and which had an average fiber length of 110 mm, into a fasciated spun yarn A of 16 S (in yarn count number) at a spinning speed of 370 m/min.

On the other hand, the pneumatic tube was replaced by a tube having a horn-shaped fiber bundle guide passage throughout its length, and the same slivers as the aforementioned ones were spun under the same conditions to produce a fasciated spun yarn B.

For the aforementioned fasciated spun yarns A and B, the number of fuzz having a length larger than 5 mm, the number of deteriorated wrapping fibers, the number of drawing neps after two passages through a winder and the weaving properties in producing a blanket when the spun yarns A and B were used as ground yarns were examined. The results are tabulated in Table 5. Especially, the blanket which was woven of the fasciated spun yarn A, had an excellent quality and was found not to be substantially different from a blanket made of a ring spun yarn of 30 S/2.

TABLE 5

| | Fasciated Spun Yarn A | Fasciated Spun Yarn B |
|---|---|---|
| No. of Long Fuzz (per meter) | 18 | 56 |
| No. of Deteriorated Wrapping Fibers (per 1000 m) | 0.1 | 187 |
| No. of Drawing Neps of Winder (per 200 m) | 0.3 | 80 |
| Weaving Properties of Blanket | Good | Poor |

We claim:

1. An apparatus for making a fasciated spun yarn, comprising: a pair of front rollers; a false twisting nozzle; and a pneumatic tube provided between said front rollers and said false twisting nozzles for allowing a bundle of fibers being twisted to pass therethrough in a linear form, said pneumatic tube being formed on its one side with an opening which has communication with an external vacuum source, wherein the improvement resides in that said pneumatic tube has a rectangular cross-section and the side opening communicating with said external vacuum source has a rectangular cross-section.

2. An apparatus as set forth in claim 1, wherein said side opening is sized to have a width $d_2$ at least 2.5 times as large as a height $d_1$.

3. An apparatus as set forth in claim 2, wherein the following dimensional relationships hold:

$$l_2 \geqq d_2 > \tfrac{3}{4} l_2,$$

wherein $l_2$ is the width of said pneumatic tube inlet opening and $d_2$ is the width of said pneumatic tube side opening.

4. An apparatus as set forth in claim 1 wherein said pneumatic tube has an effective area at most as large as the effective area of said inlet opening communicating with said external vacuum source.

5. An apparatus as set forth in any of the preceding claims 1 to 4, wherein the following relationships hold:

$$l_2/l > 1.5; \text{ and } d_2 > 10p,$$

wherein l is the width of the bundle of entering fibers; $l_2$ is the width of the inlet of said pneumatic tube; $d_2$ is the width of the side opening communicating with said external vacuum source; and p is the diameter of the inlet of said false twisting nozzle.

6. The apparatus as set forth in claim 5, wherein the following relationship holds:

$l_2/l$ is greater than or equal to 3.0.

* * * * *

UNITED STATES PATENT AND TRADEMARK OFFICE

CERTIFICATE OF CORRECTION

PATENT NO. : 4,463,549

DATED : August 7, 1984

INVENTOR(S) : Koji Kajita, Takashi Nakayama and Seiichi Yamagata

It is certified that error appears in the above-identified patent and that said Letters Patent is hereby corrected as shown below:

Column 2, line 58, after "fiber" insert --bundle--

Column 7, line 11, "N/N" should read --N/n--

Column 7, line 12, after "areas" insert --is--

Signed and Sealed this

*Seventh* Day of *May 1985*

[SEAL]

*Attest:*

DONALD J. QUIGG

*Attesting Officer* *Acting Commissioner of Patents and Trademarks*